United States Patent [19]

VanBenthuysen et al.

[11] Patent Number: 4,670,629

[45] Date of Patent: Jun. 2, 1987

[54] ALTERNATE ACTION PUSH-PUSH SWITCH

[75] Inventors: John D. VanBenthuysen; John Zdanys, Jr., both of Elkhart; Matthew D. Nold, Osceola, all of Ind.

[73] Assignee: CTS Corporation, Elkhart, Ind.

[21] Appl. No.: 746,776

[22] Filed: Jun. 20, 1985

[51] Int. Cl.[4] ..... H01H 9/26

[52] U.S. Cl. ..... 200/5 C; 200/5 B; 200/16 D; 200/153 J; 200/153 V

[58] Field of Search ..... 200/5 C, 16 R, 16 D, 200/153 J, 153 M, 153 V, 159 A, 254

[56] References Cited

U.S. PATENT DOCUMENTS

| | | | |
|---|---|---|---|
| 2,978,555 | 4/1961 | Jones | 200/153 J |
| 3,094,591 | 6/1963 | Hill | 200/16 R |
| 3,542,988 | 11/1970 | Baldasare | 200/153 J |
| 3,824,362 | 7/1974 | Bury | 200/153 J |
| 3,902,032 | 8/1975 | Koepke | 200/153 M |
| 3,946,181 | 3/1976 | Takamizawa et al. | 200/159 R |
| 4,112,277 | 9/1978 | Kleeb | 200/153 J |
| 4,225,758 | 9/1980 | Kondo et al. | 200/4 |
| 4,316,065 | 2/1982 | Rupp et al. | 200/61.89 |
| 4,392,029 | 7/1983 | Schaad et al. | 200/5 B |
| 4,475,015 | 10/1984 | Kobayashi et al. | 200/5 R |
| 4,497,983 | 2/1985 | Galloway et al. | 200/5 R |

FOREIGN PATENT DOCUMENTS

| | | | |
|---|---|---|---|
| 3145803 | 5/1983 | Fed. Rep. of Germany | 200/153 J |
| 1324091 | 7/1973 | United Kingdom | 200/153 J |
| 2047004 | 11/1980 | United Kingdom | 200/159 A |

*Primary Examiner*—Charles Frankfort
*Assistant Examiner*—W. Morris Worth
*Attorney, Agent, or Firm*—Rodger H. Flagg

[57] ABSTRACT

An alternate action push-push switch is disclosed, having a housing with a dielectric bar portion; a plurality of conductive terminals; a plurality of conductive spring contactors having an inclined segment in proximity to the dielectric bar portion and a contact segment in proximity to the terminal contact portion; at least one push member slideably disposed at least partially within the housing; an alternate action switch mechanism having a closed loop cam slot, a cam follower, and a resilient spring disposed between the housing and the push member, to provide unidirectional travel of the cam follower in the cam slot as the push member is alternately biased between first and second operating positions. More than one push member may be used to supply multiple switching configurations. A protrusion on a first push member may be adapted to actuate an adjoining second push member, while allowing the second push member to be operated independently of the first push member. This switch provides a snap action, sliding contact and release which is particularly useful for D.C. switching.

15 Claims, 7 Drawing Figures

FIG. 5
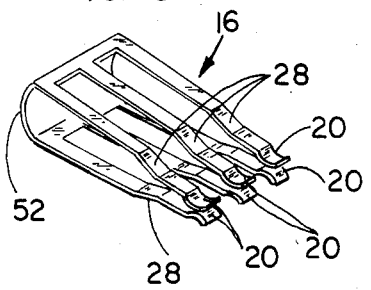
FIG. 3
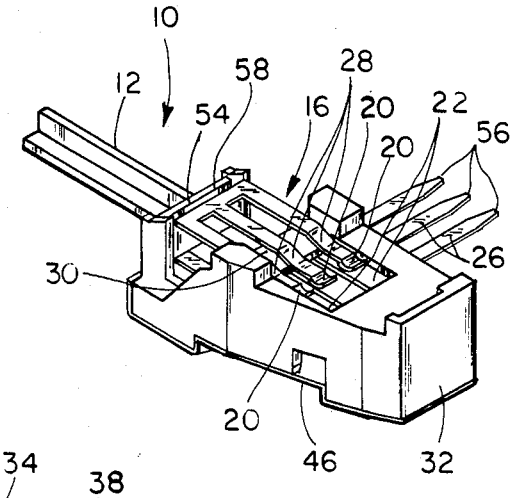
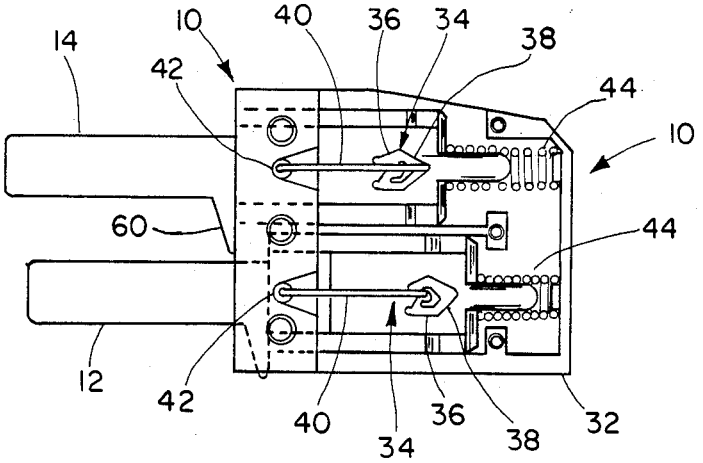
FIG. 4
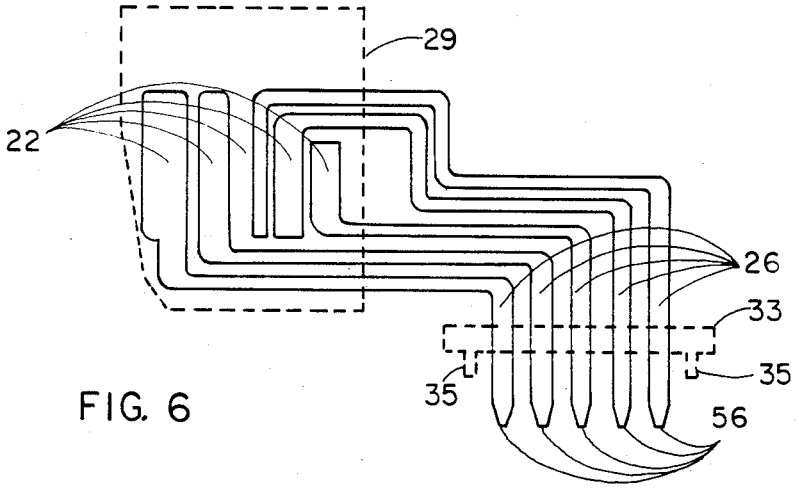
FIG. 6

ALTERNATE ACTION PUSH-PUSH SWITCH

TECHNICAL FIELD

An alternate action, push-push switch having a long service life is disclosed. The switch may be adapted for multiple control D.C. current switching, such as for headlight and parking light vehicle switch functions, wherein actuation of the headlight switch actuates the parking light switch, yet the parking light switch may be actuated independently of the headlight switch.

RELATED PRIOR ART

U.S. Pat. No. 4,497,983 discloses opposing pairs of multiple sliding contacts slidably biased between metal and dielectric sections.

U.S. Pat. No. 4,392,029 shows a multiple push button switch having a latching spring arm and a plurality of terminals.

U.S. Pat. No. 4,475,015 relates to a multiposition switch having a plurality of terminals extending within the switch housing to selectively contact the movable portion of the switch.

U.S. Pat. No. 4,316,865 discloses a plunger switch employing an inclined ramp to bias a spring loaded contact element.

U.S. Pat. No. 4,225,758 teaches opposing spring contacts positioned to engage terminals when the shaft is depressed.

U.S. Pat. Nos. 4,112,277 and 3,824,362 show a racetrack mechanism for alternate actuation of a push-push switch.

U.S. Pat. No. 3,946,181 relates to a push button switch having an opposed spring contact slidably disposed in a housing to selectively engage terminal portions and dielectric portions.

BACKGROUND ART

The need for a reliable, economical push-push switch, having a minimum of moving parts for controlling a plurality of switching functions is apparent to those employing push-push switches for D.C. current in the automotive, marine and electronic industries, and the like.

One problem encountered with existing push-push switch technology is the eventual build-up of a film of dielectric material on the contact portion of the contactor as it alternately moves between the conductive terminals and the dielectric material. This shortens the life of the switch, as dielectric build-up fouls conductivity between the contact portion of the contact and the terminal, causing the switch in time to fail.

Another problem encountered with some push-push switches is the accidental actuation of the switch caused by vibration or tentative movement of the switch actuator.

Yet another problem encountered with D.C. current switching is the arcing between contactor and terminal as contact is made or broken.

DISCLOSURE OF THE INVENTION

The present invention provides a plurality of conductive spring contactors each having an inclined segment and a contact segment. The inclined segment is positioned to be biased by a dielectric bar portion of the switch housing. The inclined segment is located in spaced relation from the contact segment, providing a moment arm for rapid contact and separation between the contact segment of the contactor and the terminal to avoid burning, arcing or otherwise fouling the contactor or terminal during D.C. current use. By separating the biasing function from the contact function, the eventual build-up of dielectric material on the contact segment is eliminated, as the contact segment of the contactor never slides over the dielectric material as is common with other push-push switch configurations.

Therefore, one object of the invention is to disclose a novel push-push switch.

Another object is to provide an improved push-push switch having a conductive spring contactor with an inclined segment and a contact segment disposed in spaced relation in a manner to isolate the contact segment from contact with any dielectric material during actuation.

Another object is to provide an opposed horseshoe contactor configuration to provide a redundant contact between contactor and opposing sides of a terminal when the switch is in the contact-operating position.

Another object is to provide a multiple push-push alternate action switch configuration.

Yet another object is to provide multiple actuation of at least two contactors when a first contactor is actuated; wherein the second contractor acts independently of the first contractor.

Still another object is to provide for some lost motion between the contactor and the push member to avoid accidental actuation from vibration or tentative movement of the push member.

Yet another object is to provide a contact segment adapted to jump ahead as the inclined segment is biased by the dielectric bar portion to provide a snap action sliding contact between the contact segments and the terminal.

The above-mentioned and other features and objects of this invention and the manner of attaining them will become more apparent and the invention itself will be best understood by reference of the following description of an embodiment of the invention, when considered in conjunction with the accompanying drawings.

BRIEF DESCRIPTION OF THE DRAWINGS

FIG. 3 is a cross sectional view of an embodiment of the switch having a single contactor biasing means.

FIG. 4 is a sectional view of the alternate action switch mechanism taken along lines 4—4 in FIG. 1, wherein the first contactor biasing means is shown in the first contact operating position and the second contactor biasing means is shown in the second non-contact operating position.

FIG. 5 is a perspective view of a first plurality of contactors, showing the preferred, opposed horseshoe configuration.

FIG. 6 is a view of a plurality of terminals with the switch housing and terminal support member shown in dashed lines.

BEST MODE FOR CARRYING OUT THE INVENTION

Figure 1:
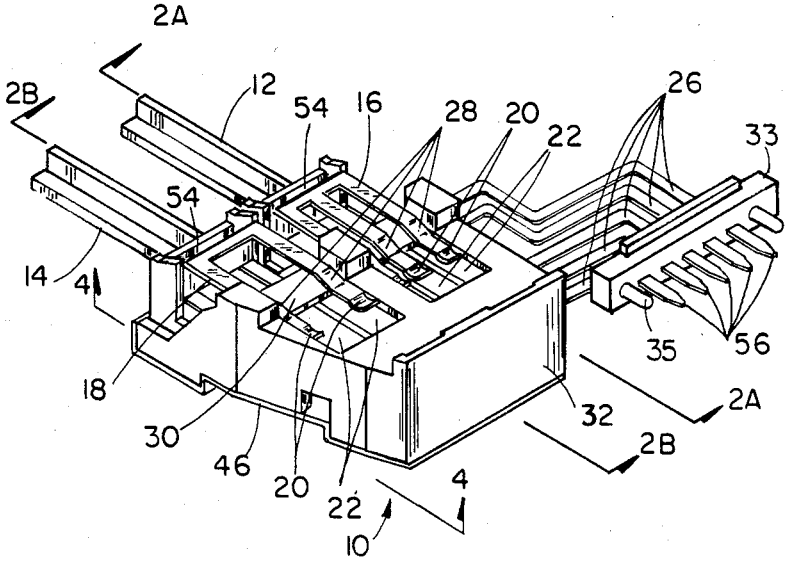
FIG. 1 is a perspective view of the preferred push-push switch having dual contactor biasing means.
Figure 2A:
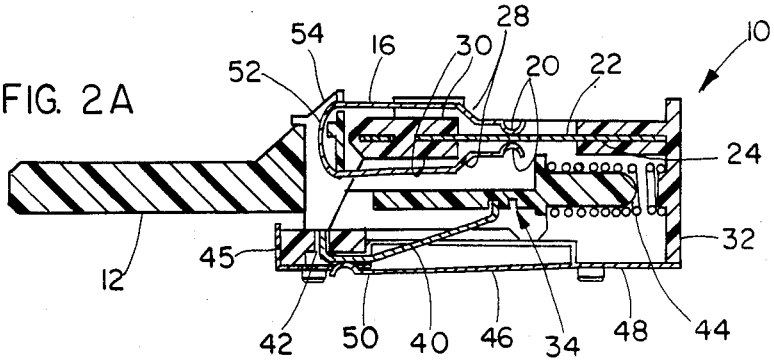
FIG. 2A is a cross sectional view of the switch taken along lines 2A—2A in FIG. 1, wherein the switch is shown in the first contact operating position.
Figure 2B:
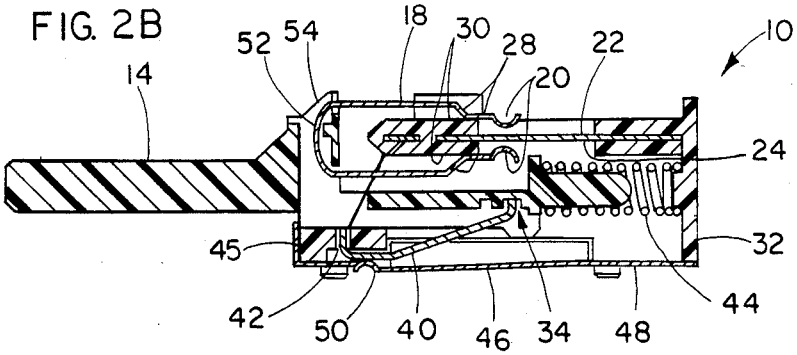
FIG. 2B is a cross sectional view of the switch taken along lines 2B—2B in FIG. 1, wherein the switch is shown in the second non-contact operating position.

The subject matter which we regard as our invention is particularly pointed out and distinctly claimed in the claims. The structure and operation of our invention, together with further objects and advantages, may be better understood from the following description given in connection with the accompanying drawings in which:

FIG. 1 shows the preferred, alternate action, multiple push-push switch 10, having first and second push members 12, 14 providing a means to linearally bias the contactors 16, 18 from a first contact operating position shown in FIG. 2A to a second non-contact operating position shown in FIG. 2B.

Contacts 16, 18 are preferably formed into an opposed horseshoe configuration wherein opposing contact segments 20 are biased toward each other as shown in FIG. 5, to provide redundant electrical communication between contact segment 20 of contactors 16, 18 and terminal contact portions 22, 24 on opposite sides of terminals 26.

Contact segment 20 is disposed in spaced relation to inclined segment 28 in a manner to provide a moment arm for rapid actuation to make or break electrical communication between contact segment 20 and terminal contact portion 22, 24 as the push-push switch 10 is actuated between first and second operating positions.

Inclined segment 28 of contactor 16 or 18 acts against dielectric bar portion 30 of switch housing 32 as the contactor is linerally biased by said push members to make or break electrical communication between contact segment 20 and terminal contact portion 22, 24. Due to the spaced relation between contact segment 20 and inclined segment 28, the make or break electricl communication is rapidly actuated to avoid fouling or burning the contact segments of contactors 16, 18 and terminals 26. This is especially important when the switch is used for high amperage D.C. current switching, such as 10 to 20 amps. The contact segment 20 of contactors 16, 18 are configured to never rub across the dielectric bar portion 30, eliminating the eventual build-up of dielectric material on contact segment 20, which increases the life of the switch, and avoids fouling the contact surface with a film of dielectric material during repeated use.

Preferably, the inclined segment 28 of contactor 16 or 18 acts against the edge of dielectric bar portion 30 to rapidly make contact and permit said push members to advance contact segment 20 along terminal contact portion 22 to provide a snap action sliding contact. The lost motion or delay between actuation of said push members and movement of said contactors actuation provided by aperture 54 allows contact segment 20 of contactor 16 or 18 to rapidly contact terminal contact portion 22 and advance along a portion of terminal contact portion 22 to provide a self-cleaning contact between contact segment 20 and terminal contact portion 22.

As shown in FIG. 2A, the push member 12 is shown in contact-operating positions wherein contactor 16 is linearally biased by push member 12 to a position permitting contact between contact segment 20 and terminal contact portion 22, 24, while inclined segment 28 of contactor 16 is biased free of contact with dielectric bar portion 30. The contact segment 20 is slideably biased by said push member after making contact with terminal portion 22, 24 to provide a self-cleaning contact and to ensure that the contact portion 22, 24 of terminal 26 is never fouled by arcing during initial contact or release.

Push member 12 is alternately linearally biased as shown in FIG. 2B to a non-contact operating position, wherein inclined segment 28 of contactor 16 engages dielectric bar portion 30 to bias contactor contact segment 20 to provide a snap action to break electrical communication between contact segment 20 and terminal contact portion 22, 24.

The preferred embodiment of this push-push switch 10 may be configurd for one or more push members. FIG. 1 shows two push members 12, 14 configured to provide independent linear actuation of contactors 16, 18. FIG. 3 shows an alternate embodiment of this invention, wherein a single push member 12 is provided to linearlly bias contactor 16 between a first contact operating configuration, and a second non-contact operating configuration. Regardless of the number of switching operations to be performed, the function of each switch configuration remains as herein disclosed.

FIG. 4 shows the preferred alternate action switching mechanism 34 having a cam slot 36 disposed upon the push members 12, 14, in a manner to form a closed loop 38.

Cam follower 40 is pivotally secured at end 42 to switch housing 32, and is formed to engage cam slot 36 in a manner to provide unidirectional travel of cam follower 40 in cam slot 36. It is within the scope of this invention to alternately configure the cam slot 36 upon the switch housing 32, and to rotatably secure the cam follower 40 to push member 12, in a manner to achieve similar results.

A spring biasing means 44 is disposed between the switch housing 32 and the push member 12 or 14 to linearally bias the contactors 16 or 18, to guide the cam follower 40 along cam slot 36 between first and second operative positions to provide an alternate action switch mechanism 34.

A biasing arm 46 may be secured at one end 48 to switch housing 32, with the biasing end 50 positioned to bias the cam follower 40 into cam slot 36 to provide engagement of the cam follower 40 in the cam slot 36 as the alternate action switching mechanism 34 is biased between first and second operative positions. As shown in FIG. 2B, push member 14 is linearally biased within housing 32 by spring biasing means 44 acting against housing 32 to move push member 14 away from housing 32. Travel of push member 14 away from housing 32 is limited by end 45 of biasing arm member 46.

FIG. 5 is a perspective view of the preferred contactor 16 having an opposed horseshoe configuration formed with contact segments 20 disposed in spaced relation to inclined segments 28. The formed end 52 of contactor 16 or 18 is preferably disposed in an aperture 54 in push member 12 or 14 in a manner to provide some lost motion as the push member 12 or 14 is partially biased to reduce the hazard of accidental actuation between first and second operative positions, due to vibration or other tentative movement of push member 12, 14. The inclined segment 28 of contactor 16 or 18 biases contact segments 20 toward each other as the contactor 16 or 18 is linearly biased by the push member 12 or 14 to provide a snap action sliding contact between contact segment 20 and terminal contact portion 22, which is self cleaning due to the continued sliding motion after contact has been established between the contact segment 20 and the terminal contact portion 22.

FIG. 6 is a plan view of a plurality of terminals 26 disposed in spaced relation to each other. A dash line 29 is used to indicate the preferred position of the switch housing 32 during molding. Terminal contact portions 22, 24 are preferably located adjacent to the dielectric bar portion 30 of switch housing 32. A terminal support member 33 may be molded or otherwise secured to terminals 26 to provide support for terminals 26.

In the preferred configuration shown in FIG. 1, a pair of push members 12, 14 are slideably disposed at least partially within switch housing 32. One push member 14 is adapted for control of a first electrical function, such as an automotive headlight switch. A second push member 12 is adapted to control a second, independent switching function such as automotive parking lights. As shown in FIG. 4, a protrusion 60 may be positioned upon push member 12 or 14, to contract adjoining push member when the push member is linearally biased as previously disposed. As shown in FIG. 4, actuation of push member 14 will also actuate push member 12; enabling push member 14 to act with the actuation of an adjoining push member 12, while allowing push member 12 to be biased independently of push member 14. Actuation of push members 12 and 14 may be simultaneous or by controlling the dimensional position between inclined segment 28 and dielectric bar portion 30, actuation may be slightly delayed so that a first contactor 16 or 18 makes or breaks electrical communication prior to making or breaking electrical communication between a second contactor 16 or 18. Thus in the use previously disclosed, the push member 12, controlling the parking lights may be actuated independently of the push member 14 controlling the headlights, while the push member 12 controlling the parking lights will always be actuated with actuation of the push member 14 controlling the headlights.

Terminals 26 are disposed in spaced relation to each other, and are preferably molded into a dielectric portion of housing 32. Terminal ends 56 may be positioned to receive a complementary terminal (not shown) for releasable electrical communication with a remote electrical apparatus. A terminal support member 33 may include guide pins 35 to position terminals 26 within the complimentary terminal.

Thus, in operation of the preferred embodiment shown in FIGS. 1 and 4, push member 14 may be linearally biased to the first operative position, which acts through edge of aperture 54 to linearally bias the inclined segment 28 of contactor 18 beyond dielectric bar portion 30, allowing the biased contact segments 20 to make contact with the contact portion 22 and/or 24 of terminals 26 to provide electrical communication between a plurality of terminals. Push member 14 may be repeatedly cycled to provide alternate actuation, as the alternate action switching mechanism provides for unidirectional travel of cam follower 40 in cam slot 36 along closed loop 38. Spring biasing means 44 acts against movement of push member 14 to seat cam follower in alternating first and second operating positions.

Protrusion 60 on push member 14 engages push member 12 when push member 12 is biased to move both contactors 16, 18 in a manner previously described. However, actuation of push member 12 does not bias push member 14 in the non-contact operating position, allowing push member 12 to be independently controlled, as shown in FIG. 4. Thus, the disclosed push-push switch may be configured with one or more push members 12, 14 to linearally bias one or more contractors 16, 18 between a first contact-operating position and a second non-contact operating position to control one or more electrical functions.

INDUSTRIAL APPLICABILITY

This invention is intended for use as an alternate action push-push switch, for use to control at least one switching function in an electric circuit, or the like.

This switch is adapted for use in a variety of electrical switch applications, including automotive and marine use; and for use on electronic equipment, or where manual actuation of an electrical switching function is desired. The disclosed switch is particularly useful for use with D.C. current.

CONCLUSION

Although the present invention has been illustrated and described in connection with an example embodiment, it will be understood that this is illustrative of the invention, and it is by no means restrictive thereof. It is reasonably to be expected that those skilled in the art can make numerous revisions and additions to the invention and it is intended that such revisions and additions will be included within the scope of the following claims as equivalents of the invention.

We claim:

1. An electrical push-push switch having a housing, a plurality of terminals, and an alternate action switch mechanism for selectively biasing a contactor between a first contact operating position and a second non-contact operating position, in which the improvement comprises:

(a) a fixed dielectric bar portion secured to and within the switch housing in proximity to the terminals;

(b) at least one conductive spring contactor having a common portion and at least two upper and lower elongated extensions thereon, each upper extension having an upper inclined segment disposed above the bar portion and each lower extension having a lower inclined segment disposed opposite said upper inclined segment and below the bar portion; each upper extension with an upper contact segment disposed in spaced relation from the upper inclined segment and each lower extension with a lower contact segment disposed in spaced relation from the lower inclined segment, the upper contact segment disposed above at least one of the plurality of terminals, and the lower contact segment being oppositely disposed and below said at least one of the plurality of terminals;

(c) at least one linearly biased push member slidably received at least partially within the housing;

(d) an aperture disposed in the push member to receive said common portion of the contactor therethrough, the aperture sized to provide some lost motion between movement of the push member and corresponding movement of the contactor as the push member is partially moved inwardly of the housing biased to thereby reduce the hazard of accidental actuation between first and second operating positions, wherein further movement of the push member allows the contactor to provide snap action sliding contact between the upper and lower contact segments of the contactor and terminal contact portions of at least two of the plurality of terminals as the push member is actuated to the first contact operating position, and the upper and lower inclined segments of the contactor are biased by the dielectric bar portion of the housing to break electrical contact between the upper and lower contact segments of the contactor and the terminal contact portions of said at least two of the plurality of terminals when the contactor is moved by the push member into the second non-contact operating position, with the uppper and lower contact segments of the contactor configured to avoid contact with the dielectric bar portion of the housing in both first and second operating positions.

2. The switch of claim 1, wherein each contactor is preferably formed into an opposed horseshoe configuration having a common portion with at least two upper extensions slidably disposed above the bar portion, and at least two lower extensions slidably disposed below the bar portion, the upper and lower contactor extensions each forming opposed inclined segments and opposed contact segments in spaced relation; the opposed contact segments each providing a redundant contact to upper and lower surfaces respectively of said at least one of the plurality of terminals when said contactor is in the first contact operating position, and the opposed inclined segments each positioned to be engaged by the bar portion to thereby break contact between the opposed contact segments and the terminals when the contactor is slidably biased away from said housing by actuation of the push member to the second non-contact operating position.

3. The switch of claim 1, wherein the terminals are partially molded within the housing in spaced relation, with a terminal contact segment exposed above and below the terminals in proximity to the dielectric bar portion, and with a portion of the terminals extending in spaced relation beyond the housing for engagement with a complimentary terminal element for electrical communication therebetween.

4. The switch of claim 1, wherein the alternate action switch mechanism comprises:

(a) a cam slot disposed upon a surface of said push member, said cam slot forming a non-stepped, closed loop cam surface;

(b) a cam follower pivotally secured at one end to the switch housing, and formed to engage the cam slot in a manner to provide unidirectional travel of the cam follower in the cam slot;

(c) a spring biasing means disposed between the housing and the push member to resist the push-push actuation of the alternate action switch mechanism; wherein the cam slot, cam follower and spring biasing means are configured to provide alternate actuation of the switch mechanism between first and second operating positions.

5. The switch of claim 4, wherein one end of a biasing arm is secured to the switch housing, and the biasing arm is positioned to bias the cam follower into the cam slot, as the push member is biased between first and second operating positions.

6. The switch of claim 1, wherein a first contactor is linearly biased by a first push member, a second contactor is linearly biased by a second push member, and the first and second push members are slidably received at least partially within the housing; the first push member is adapted with a protrusion positioned to engage the second push member to provide multiple actuation of the first and second push members when the first push member is actuated between first and second operating positions, while the second push member may be actuated without effecting movement of the first push member when the first push member is in the second non-contact operating position.

7. The switch of claim 6, wherein the inclined segment of the first and second contactors are disposed in relation to the bar portion of the housing to provide sequential actuation of the first and second contactors during multiple actuation of the first and second push members between first and second operating positions.

8. An electrical push-push switch, which comprises:

(a) a housing having a dielectric bar portion affixed thereto and disposed within;

(b) a plurality of conductive terminal means disposed in spaced relation within a dielectric portion of the housing, the terminal means each having an upper and lower contact portion in proximity to the dielectric bar portion, with a portion of the terminal means extending beyond the housing for electrical communication therefrom;

(c) at least one conductive spring contactor; each contactor formed into an opposed horseshoe configuration having a common portion with at least two upper extensions slidably disposed above the bar portion, and at least two lower extensions slidably disposed beneath the bar portion, the upper and lower extensions each forming opposed inclined segments and opposed contact segments, the opposed contact segments each providing a redundant contact to upper and lower surfaces of one of said at least one of the terminal means when in a first operating position, and the opposed inclined segments each positioned to be biased to break contact between the opposed contact segments and the terminal means when the contactor is slidably biased to a second operating position;

(d) at least one linearly biased push member slidably received at least partially within the housing, each push member having an aperture sized to receive said common portion of the contactor therethrough, the aperture sized to provide some lost motion between movement of the push member and corresponding movement of the contactor as the push member is partially moved inwardly of the housing; and (e) an alternate action switch means for selectively biasing the contactor between the first and second operating positions, wherein actuation of the push member to a first contact operating position allows the contactor to provide a snap action sliding contact between the contact elements of the contactor and the upper and lower contact surfaces of at least two terminal means, and the inclined segment of the contactor is biased by the bar portion of the housing to break electrical contact between the contactor contact segments and the terminal means when the contactor is linearly biased by the push member into the second non-contact operating position.

9. The switch of claim 8, wherein the linear contactor biasing means comprises:

(a) a push member slidably received at leat partially within said housing;

(b) an aperture disposed in the push member to receive the contactor therethrough in a manner to alternately bias the contactor between the first contact operating position and the second non-contact operating position as the push member is subsequently biased.

10. The switch of claim 8, wherein the alternate action switch means comprises:

(a) a cam slot disposed upon a surface of the push member, the cam slot forming a non-stepped, closed loop cam surface;

(b) a cam follower pivotally secured at one end to the switch housing, and formed to engage the cam slot in a manner to provide unidirectional travel of the cam follower in the cam slot;

(c) a spring biasing means disposed between the housing and the push member to resist the push-push actuation of the alternate action switch means;

(d) a biasing arm secured to the housing and positioned to bias the cam follower into the cam slot during actuation of the alternate action switch means, wherein the cam slot, cam follower, spring biasing means and the biasing arm are configured to provide alternate actuation of the switch mechanism between first and second contact operating positions.

11. The switch of claim 8, wherein a first contactor is linearly biased by a first push member, a second contactor is linearly biased by a second push member, and the first and second push members are slidably received at least partially within the housing; the first push member is adapted with a protrustion positioned to engage the second push member to provide multiple actuation of the first and second push members when the first push member is actuated between first and second operating positions, while the second push member may be actuated without effective movement of the first push member when the first push member is in the second non-contact operating position.

12. The switch of claim 11, wherein the inclined segment of the first and second contactors are positioned to provide sequential actuation of the first and second contactors during multiple actuation of the first and second push members between first and second operating positions.

13. A dual action electrical push-push switch, which comprises:

(a) a housing having at least one dielectric bar portion affixed thereto and disposed therein;

(b) a plurality of conductive terminals disposed in spaced relation at least partially within a dielectric portion of the housing, each terminal having an upper and lower contact surface in proximity to the dielectric bar portion;

(c) at least a first and second push member, each independently slidably disposed at least partially within the housing, each push member having an aperture therethrough;

(d) at least a first and second conductive spring contactor, each contactor formed into an opposed horseshoe configuration with at least two upper and two lower extensions positioned to be slidably disposed about the bar portion of the housing, each extension having an inclined segment and a contact segment, each upper and lower contact segment of the contactor providing a redundant contact against the upper and lower contact surfaces of one of the plurality of terminals; each contactor partially disposed through the aperture in the push member with the aperture sized to provide some lost motion between movement of the push member and corresponding movement of the contactor as the push member is partially moved inwardly of said housing; and (e) at least a first and second alternate action switch member, each comprising a closed loop cam slot disposed upon one of the push members, a cam follower pivotally secured at one end to the switch housing and formed to engage one of the cam slots in all operating positions, and spring biasing means positioned to bias each push member, wherein actuation of one of the push members biases at least one contactor to provide a snap action sliding contact between at least two of the opposed contact segments and the upper and lower contact surfaces of at least two terminals when the actuated push member is pushed into the first contact operating position; and the inclined segments of at least one contactor are biased by the bar portion of the housing to break electrical contact between the contact segments and said at least two terminals when the actuated push member is again pushed to bias the contact into the second non-contact operating position.

14. The switch of claim 13, wherein the first push member is adapted with a protrusion positioned to engage the second push member to provide multiple actuation of the first and second push members when the first push member is biased between first and second operating positions, while the second push member may be actuated without effecting movement of the first push member is in the second non-contact operating position.

15. The switch of claim 13, wherein the inclined segment of the first and second contactors are disposed in relation to the bar portion of the housing to provide sequential actuation of the first and second contactors during multiple actuation of the first and second push members between first and second operating positions.

* * * * *